United States Patent [19]

Marforio

[11] 3,972,296

[45] Aug. 3, 1976

[54] DEVICE FOR CUTTING AND INSERTING A CONTINUOUSLY FED RIBBON UNDERNEATH THE PRESSURE FOOT OF A SEWING MACHINE

[75] Inventor: Nerino Marforio, Milan, Italy

[73] Assignee: Rockwell-Rimoldi S.p.A., Milan, Italy

[22] Filed: Dec. 17, 1974

[21] Appl. No.: 533,500

[30] Foreign Application Priority Data

Dec. 27, 1973 Italy ..... 32288/73

[52] U.S. Cl. ..... 112/121.27; 112/152; 112/130

[51] Int. Cl.[2] ..... D05B 35/06

[58] Field of Search ..... 112/121.27, 121.26, 112/152, 130, DIG. 2, DIG. 3, 136; 271/194, 195

[56] References Cited

UNITED STATES PATENTS

| | | | |
|---|---|---|---|
| 1,195,767 | 8/1916 | Berger, Jr. | 112/152 X |
| 1,912,724 | 6/1933 | Remington | 271/195 X |
| 2,664,839 | 1/1954 | Cummins | 112/152 |
| 3,204,591 | 9/1965 | Pickett | 112/136 X |
| 3,648,632 | 3/1972 | Miller | 112/130 |
| 3,855,955 | 12/1974 | Strang | 112/152 |

*Primary Examiner*—Werner H. Schroeder
*Assistant Examiner*—Peter Nerbun

[57] ABSTRACT

A device for inserting a ribbon beneath the presser foot of a sewing machine for application to a workpiece and for cutting off said ribbon to predetermined length cyclically by automatic or semiautomatic means. The ribbon is fed continuously to the sewing machine during the stitching operation.

1 Claim, 2 Drawing Figures

DEVICE FOR CUTTING AND INSERTING A CONTINUOUSLY FED RIBBON UNDERNEATH THE PRESSURE FOOT OF A SEWING MACHINE

BACKGROUND OF THE INVENTION

The present invention relates to a device for cutting and inserting a continuously fed ribbon beneath the presser foot of a sewing machine for sewing onto a layer of fabric. The ribbon which is to be sewn to the fabric is usually continuously drawn from a reel, and is cut after having been sewn to the fabric, into pieces of different length utilizing a cutting means, for example of the scissors type located in operative association with the presser foot and the sewing elements.

For inserting the cut end of ribbon extending from the reel to a position beneath the presser foot, the known art utilizes a guide along which the length of ribbon is caused to move by means of pusher element acting on said ribbon which is operatively connected to said guide. When the length of ribbon has been inserted beneath the presser foot, the material moving elements of the sewing machine are effective in returning the guide to the reel.

The guide is caused to move to a position adjacent the presser foot and the sewing means leaving a space therebetween which permits the cutting means to cut the ribbon after the sewing cycle. In known devices of this type, the space between the lower end of the guide and presser foot makes the insertion of the ribbon beneath the presser foot rather difficult because the ribbon tends to curl up owing to the inevitable presence of folds and burrs in the ribbon frequently caused by the cutting of the same. Often, and particularly when the ribbon is that of a very flexible material, the ribbon curls completely up before reaching the presser foot.

SUMMARY OF THE INVENTION

The present invention provides a means of eliminating the above-mentioned condition by assuring that the ribbon enters beneath the presser foot parallel to the fabric to which it is to be attached. This means is accomplished by a device that is adapted to cut and insert a length of ribbon beneath the presser foot of a sewing machine and includes a guide through which the ribbon is caused to be advanced by a pushing means during the phase of controlling the insertion of the ribbon beneath the presser foot. The device also includes a means for cutting the ribbon and is located adjacent the presser foot and the end of the guide. Additionally, the device includes a charging element for conveying the ribbon beneath the presser foot and is fixed to the presser foot so that when the latter is being raised, it will also be simultaneously elevated into contact with the adjacent end portion of the guide. In addition, the device is provided with a compressed air duct directed toward this end portion of the guide and the air emitted therefrom facilitates the advance of the length of ribbon into the charging element.

Further characteristics and advantages of the present invention will become more fully apparent by reference to the appended claim and as the following detailed description proceeds in reference to the figures of drawing wherein:

DESCRIPTION OF THE PREFERRED EMBODIMENT

Figure 1:
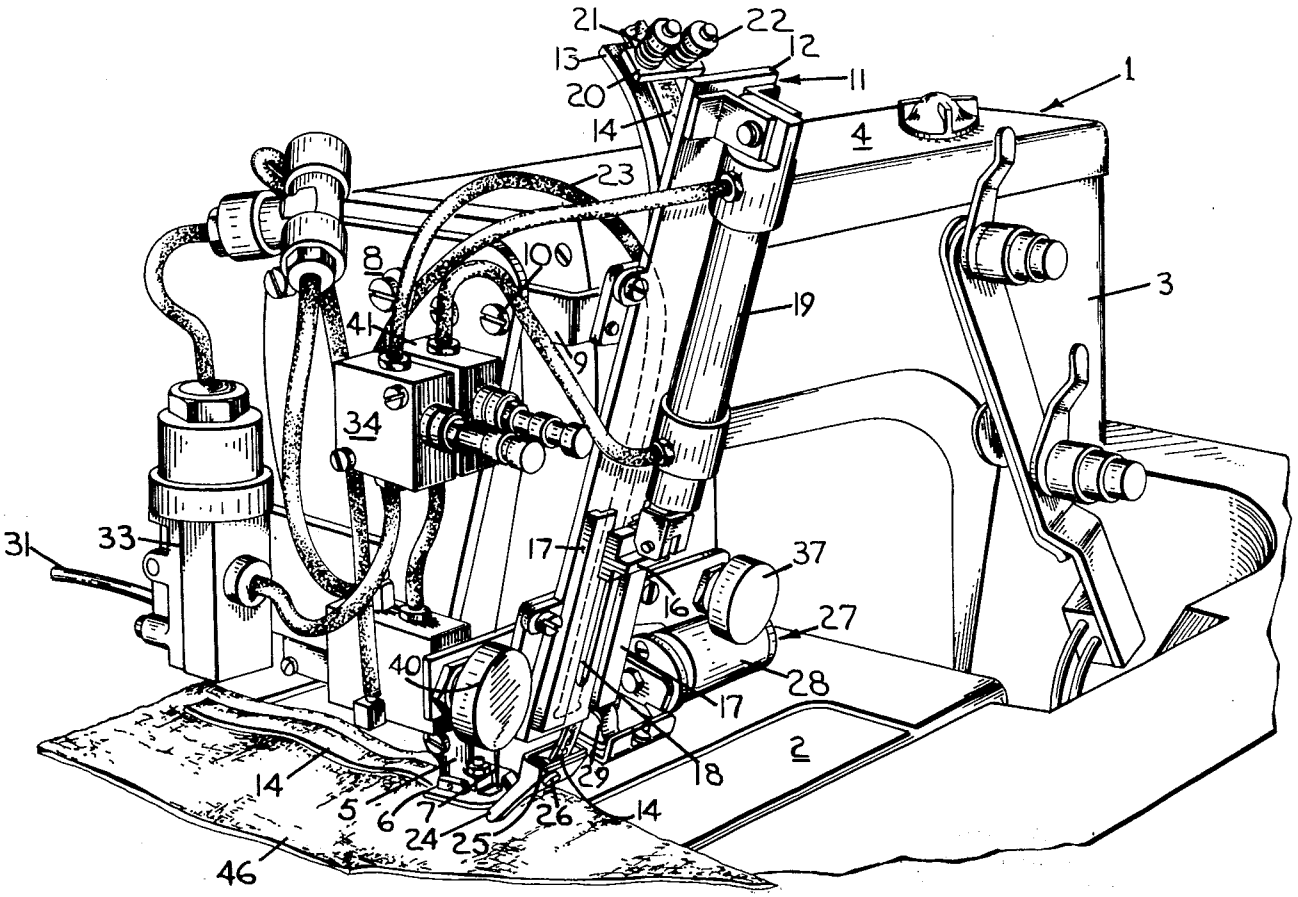
FIG. 1 is a perspective view of a conventional sewing machine showing the device according to the invention applied thereto.

Referring now to FIG. 1, the device comprising the present invention is shown fixed to a well known type of sewing machine 1 having a base 2 with a column 3 extending upwardly therefrom for supporting the usual arm 4 which contains among other elements a presser 5 with a presser foot 6 and a needle 7 carried by a well known type of needle holder not shown.

The lifting device for the presser foot 6 is pneumatically controlled and will be further described hereinafter.

A plate 8 is fixed on the end of the arm 4 of the sewing machine and has an angular bracket 9 mounted thereon for selective rotary movement about a screw or pivot 10. Rotation of the bracket about the screw or pivot 10 makes it possible to adjust the inclination of the device with respect to a vertical axis or to move it completely above the top of the arm 4 of the sewing machine for the purpose of gaining access to the sewing elements.

The bracket 9 supports a guide generally indicated by numeral 11 that is formed by two elongated plate members 12 and 13. These plate members 12 and 13 are disposed in spaced and parallel relation and provide a means for guiding a length of ribbon 14 as it is advanced therebetween. The ribbon 14, during the phase of its insertion beneath the presser foot, is advanced along the guide 11 by a ribbon-pushing device formed by a resilient blade element not shown in FIG. 1, but schematically indicated in FIG. 2 at 15. This blade element is fixed to a block 16 which is slidable between two guides 17 that are attached in spaced relation to plate 12. An elongated slot 18 is provided in plate 12 intermediate the guides 17 within which the blade element 15 extends for the purpose of exerting a biasing force against the plate 13. The actuating rod of a pneumatic cylinder 19, the latter of which is fixed to plate 12, is pivotally connected to the block 16. Two coil springs 21 having pressure adjusting screws 22 operatively associated therewith continually urge a plate 20 toward plate member 13. The plate 20 serves as a ribbon stretching device as said ribbon 14 is advanced therebetween from any suitable source such as a reel not shown. The plate member 13 of the guide 11 also supports a duct 23 for compressed air, which extends to a position adjacent the lower end of the guide 11. Fixed to the presser foot 6 a charging device 24 is provided which has a funnel-like rectangular configuration through which the ribbon 14 is adapted to pass. A diaphragm 25 is assembled within the charging device and by means of a screw 26 is adjustable for the purpose of regulating the opening to accommodate the width of the ribbon 14 being fed therethrough.

The charging device 24 is slightly inclined with respect to the presser foot so that when the latter is elevated, the upper opening of said charging device will mate with the lower end of the guide 11. The lower opening of the charging device 24 is in the same plane as the bottom of the presser foot. Adjacent the charging device's upper opening and the lower end of the guide, a scissors-type cutting means 27 of known type is provided, and is actuated by a pneumatic cylinder 28. The cutting means 27 provided to cut the ribbon is of that type in which the pneumatic cylinder 28 in addition to effecting the closing and opening of the blades 29, is also effective in controlling the movement of said cutting means to and from that position between the charging device and guide where the actual cutting operation is performed.

Figure 2:
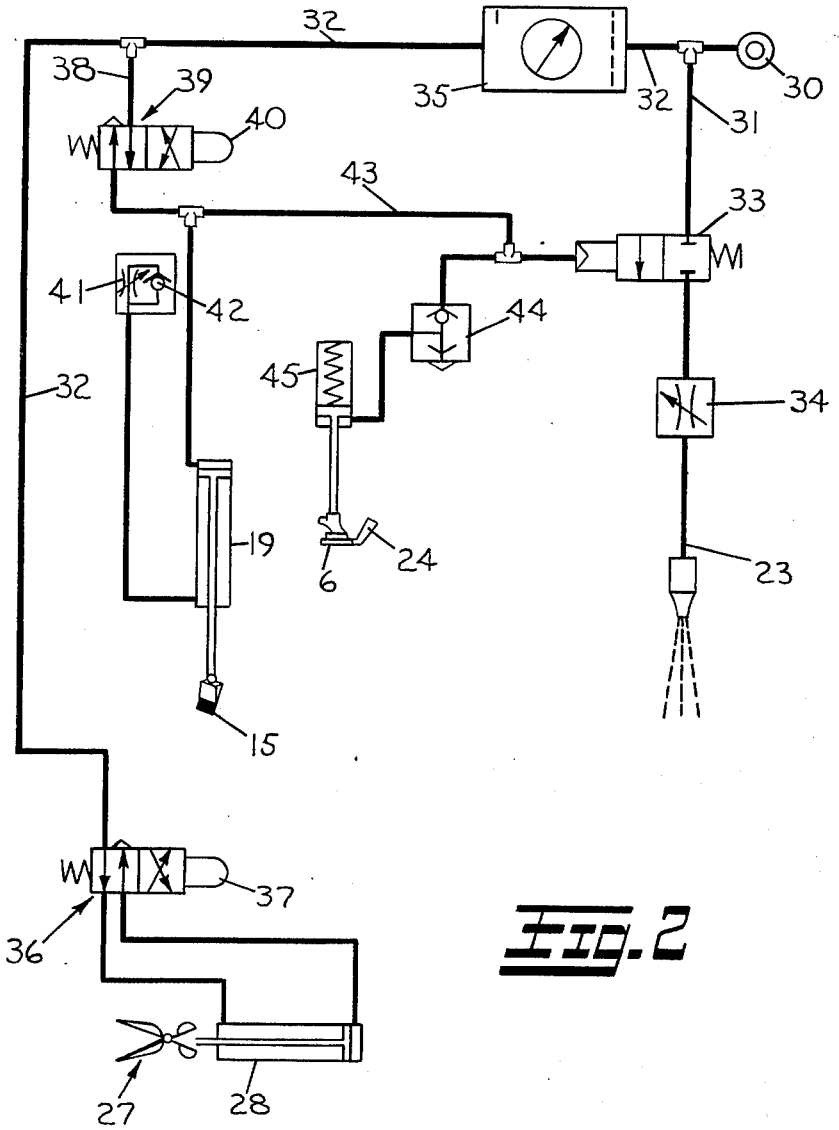
FIG. 2 is a schematic view showing the pneumatic control circuit for the device.

Referring now to FIG. 2, the pneumatic circuit for controlling the above-described device will now be described in greater detail.

The compressed-air feed duct 30 is divided into two branches 31 and 32 with branch 31 being connected to the duct 23 which extends to the lower end of the guide 11, and branch 32 is connected to the ribbon cutting means, the ribbon feeding device and the presser-foot lifting apparatus. Branch 31 includes a two-way valve 33 and a flow regulator 34 that is supported by the plate 8 as shown in FIG. 1.

Branch 32 is provided with a compressed-air control unit 35 that includes a pressure gauge, a lubricator and an air filter. Branch 32 directs air to the piston 28 for driving the cutting means 27 and the controls of a valve 36 fitted with a control push-button 37. A branch 38 connected to and extending from branch 32 includes a four-way valve 39 fitted with a control push-button 40, which controls the cylinder 19 for driving the ribbon feed device. Branch 38 leading to the cylinder 19 also includes a flow regulator 41 connected to a unidirectional valve 42. A further branch 43 connected to and extending from branch 38 serves as a pilot to the valve 33 and controls a cylinder 45 for raising the presser foot 6. The branch leading to the cylinder 45 also includes a circuit selecting valve 44.

The operation and working cycle of the device will now be described in further detail.

As a preliminary step the ribbon 14 is first manually inserted beneath the plate 20 and between the two plate members 12 and 13 to the extent that it will extend below the blade 15 of the ribbon feeding means. By pressing the push-button of the valve 39 compressed air will enter into the branch 43 and compressed air will be fed into the upper part of the cylinder 19, and supply compressed air to the cylinder 45, as well as drive the valve 33 which connects the branch 31 to the duct 23. The air in the upper part of the cylinder 19 causes the blade 15 to be lowered and the ribbon to be fed into the ribbon charging device 24 which is now in a raised or first position owing to the air supplied to the cylinder 45 which controls the motion of the presser foot 6. During this time air is flowing into the duct 23 and the air emitted therefrom facilitates the introduction of the ribbon into the charging device and prevents the ribbon from curling. The force of this air flow can be adjusted by the flow regulator 34.

The end of the ribbon 14 is pushed below the presser foot from the height of the sewing means which is possible due to the stroke of the cylinder 19 being equal to the distance between the lower end of the guide 11 and said sewing means.

At this point a layer of fabric 46 can be manually introduced beneath the presser foot 6.

By releasing the push-button 40 air flow to branch 43 is interrupted and the valve 33 is activated to interrupt the connection of the branch 31 to the duct 23 while the presser foot 6 is being lowered to a second position in contact with the workpiece. The circuit selecting valve 44 is effective in releasing the air in the cylinder 45 so that it will not enter into the branch 43 and cause the undesired re-engagement of the valve 33.

With the push-button 40 released, the lower part of the cylinder 19 is supplied with air and the blade 15 is raised to the position to effect the subsequent introduction of ribbon below the pressure foot. The speed of the downward movement of the blade 15, that is the speed of the piston of cylinder 19 can be adjusted by means of the flow regulator 41. The sewing machine can now be started as both the workpiece and the ribbon are now located beneath the presser foot. During the sewing cycle the ribbon 14 will be drawn from the reel by means of the usual feeding elements of the sewing machine. The blade 15 will not adversely effect the advance of the ribbon, because its pressure on the ribbon is so regulated that the effect of the feed elements on the ribbon is not hindered.

After a given length of ribbon has been sewn to the layer of fabric 46, the sewing machine is stopped and the push-button 37 is pressed to actuate valve 36 that is operatively connected to the cylinder 28 for controlling the ribbon cutting means. After the ribbon has been cut and the push-button 37 released, the sewing machine can again be started to sew on the length of ribbon still in the ribbon charging device or the push-button 40 is pressed to raise the presser foot, remove the workpiece and start the next sewing cycle for the application of ribbon to another workpiece.

It is obvious that technical and practical variations of the above device are possible, for example the valves 39 and 37 could be controlled by a toggle or similr device in a position depending upon the type of work to be sewn without departing from the range of application of the present invention.

I claim:

1. A device for cutting and inserting a ribbon beneath the presser foot of a sewing machine and onto a workpiece to which it is to be sewn, said device comprising:

a. a guide fixed on the sewing machine for guiding the ribbon as it is drawn from its source;

b. a ribbon charging device comprising an upwardly extending elongated passage fixed on the presser foot and movable with the latter between a first position of mating relation with the guide for receiving the ribbon therefrom and a second position in close proximity with the workpiece for inserting the ribbon between the latter and the presser foot;

c. ribbon feed means for advancing the ribbon in said guide for effecting advance of the ribbon into said charging device with the latter in said first position; and d. cutting means operatively associated with said guide and charging device for cutting the ribbon when said charging device is in said second position.

* * * * *